US006920931B1

(12) United States Patent
Webre et al.

(10) Patent No.: US 6,920,931 B1
(45) Date of Patent: Jul. 26, 2005

(54) CONTROL LINE GUIDE

(75) Inventors: Charles Michael Webre, Lafayette, LA (US); Brian David Begnaud, Youngsville, LA (US); Scott J. Arceneaux, Lafayette, LA (US)

(73) Assignee: Frank's Casing Crew and Rental Tools, Inc., Lafayette, LA (US)

( * ) Notice: Subject to any disclaimer, the term of this patent is extended or adjusted under 35 U.S.C. 154(b) by 129 days.

(21) Appl. No.: 10/315,617

(22) Filed: Dec. 10, 2002

(51) Int. Cl.[7] ..... E21B 19/22
(52) U.S. Cl. ..... 166/379; 166/77.1
(58) Field of Search ..... 166/379, 380, 166/77.1, 77.4, 77.51, 77.52

(56) References Cited

U.S. PATENT DOCUMENTS 4,523,645 A * 6/1985 Moore ..... 166/385
5,803,191 A * 9/1998 Mackintosh ..... 175/170
6,131,664 A 10/2000 Sonnier
6,412,552 B1 * 7/2002 Rooks ..... 166/77.1

* cited by examiner

*Primary Examiner*—William Neuder
(74) *Attorney, Agent, or Firm*—John D. Jeter

(57) ABSTRACT

When the spider slips are open, the control line can be moved toward the pipe string, can be clamped to the pie string and string and line can be lowered into the well. When the pipe connector approaches the spider, the spider slips need to be set. To move the control line into a safe area, it is thrust radially outward from the pipe string. The slips are closed while the line is retained outward.

To keep them safe while work proceeds just above the spider an optional trap is closed to retain the control lines until the spider slips are opened. The lines can be manually pulled outward but it is more easily done with a powered thruster. Optional sequencing controls can start with moving the control line away from the pipe, closing the line trap, and closing the spider slips. Reversing the procedure, the sequencing controls open the spider slips, release the line trap, and moves the line toward the pipe.

12 Claims, 7 Drawing Sheets

CONTROL LINE GUIDE

This invention pertains to operations and hardware for running pipe strings into well bores and assembling control lines secured to the pipe strings at the same time. Objects relate to protecting the control lines from actions of the spider and tongs while the pipe string is being worked. The protection purpose is carried out by either manual sequencing or by automatic sequencing.

BACKGROUND OF THE INVENTION

Most wells have pipe strings installed in the well bore by assembling individual lengths, joints, or sections, of pipe into a pipe string. The connecting of each added joint of pipe takes place just above a spider on or near the rig floor. The sections are usually connected by threads.

Installing pipe strings made up of sections involves alternate use of a vertically movable elevator capable of lifting the total pipe string, and a stationary spider supported by the drilling rig base structure, usually the rig floor for large pipe installation. The elevator is massive and must occasionally approach the top of the spider. Above the spider, pipe tongs usually operate during connection of new sections of pipe into the pipe string. Operation of elevator, spider and tongs endanger any light structure that is in the path of their moving parts.

It is becoming more common practice to install controllable apparatus into the pipe string and to run a controlling line, often encased in a coiled tube, to the apparatus while the pipe string is being inserted into the well. The control line may carry electric energy or signals, fluid pressure energy, or chemicals for treating wells. The control line can be installed by feeding it from a reservoir and attaching it to the pipe string as it moves downward.

If the control line is fed through the spider the opening and closing of the slips can damage the line. The line cannot be attached to the pipe until the region to which it would be attached has been released from the spider slips for the movement down hole.

If the line is to be fed through the spider, a movement ritual needs to be observed. When the elevator supports the pipe string and it is poised to move downward, the line needs to be pushed against the pipe to ease the clamping of the line to the pipe. After downward movement, and before the spider slips are closed, the line needs to be pulled radially outward from the pipe so that the spider slips can be set.

It is not uncommon to have several individual lines being installed in the well while the pipe string moves down hole during pipe string installation. The lines are normally bundled together and are managed collectively, but plural lines increase the risk of damage.

There is a need for powered mechanical means to push the lines toward the pipe when ready to move the pipe downward, and to pull the lines away from the pipe when the spider slips are to be set. There is a further need to relate the radial movement of the lines and the manipulation of the spider slips.

There is a need for means to conduct the lines through the zone subject to risk of line damage. The means to conduct the lines should be removable without cutting the lines.

SUMMARY OF THE INVENTION

To overcome the problems cited above some objectives that have guided the solution efforts are cited below.

One objective is to provide a path for the lines to move through the spider without falling under the closing force of the spider slips and slip operating mechanism.

Another objective is to secure the lines in the protective guide before the spider slips are activated for closing on pipe.

Yet another object is to provide powered means to move the lines radially relative to the pipe to move them away from the pipe to close the spider slips and to move them toward the pipe for movement down hole.

It is a further object to provide means to coordinate the means to move the lines radially and the means to secure the lines in a safe path.

It is still another object to coordinate the movement and securing actions with spider slip control such that each consecutive movement is enabled by completion of the preceding planned action.

The preferred sequence is to (1) move the lines radially outward while the pipe string is supported by the elevator but positioned for closing the spider slips. (2) Close a line securing means on or near the spider and (3) allow the completion of the above actions to enable the closing of the spider slips. Ideally, completion of step 1 enables activation of step 2.

The alternate action occurs when the pipe is supported by the spider, after a new joint has been added to the string, and ready to be moved farther into the well. The elevator slips are closed on the pipe and the load on the spider is relieved as an enabling condition for opening the spider slips. The following action then proceeds. First (1) the spider slips open and (2) the line securing means opens to permit (3) the line moving means to thrust the lines toward the pipe. Ideally step one enables step two.

To move the lines radially an optional line thrust means is mounted in the rig to engage the lines and move them toward, or away from, the pipe string suspended in the well. A line guide comprising a sheave, roller, or equivalent, contacts the lines some distance above the spider. The line guide is moved by the thrust means which is a structure, or mast, that is moved on command by fluid or electric power.

A path through the spider, to accommodate the lines, can be a trough cut in a generally vertical direction on the inside surface of the usual door on the spider. The path design depends upon the spider design but needs smooth surfaces and the lines need to be movable from the path in a generally radial direction.

Securing the lines in position after they are moved radially away from the pipe is, preferably, done by trap apparatus that intrudes least on the busy space just above the spider when the spider slips are closed. A rotating, or tumbler, gate on the line trap is preferred partly because it can be imbedded in the spider door, or frame. Unless powered, it has only one moving part, a cylinder with a side gap rotating in a sleeve with a side gap. When the gaps are aligned the lines can be moved out of the trap. A fluid or electric switch on the trap can, optionally, enable closing of the spider slips after the trap is closed.

Spiders of current design have fluid powered slip manipulator gear. When the slip manipulator reaches a travel limit, a pressure surge results that is usable as a position indicator. Some spiders already have position indicator switches suitable for control of apparatus of this invention. The position indicator can enable or actuate the powered means to move the lines. The powered means moves the lines toward the pipe after the slips are opened and moves the lines away from the pipe before the slips are closed.

These and other objects, advantages, and features of this invention will be apparent to those skilled in the art from a consideration of this specification, including the attached claims and appended drawings.

DETAILED DESCRIPTION OF DRAWINGS

Figure 1:
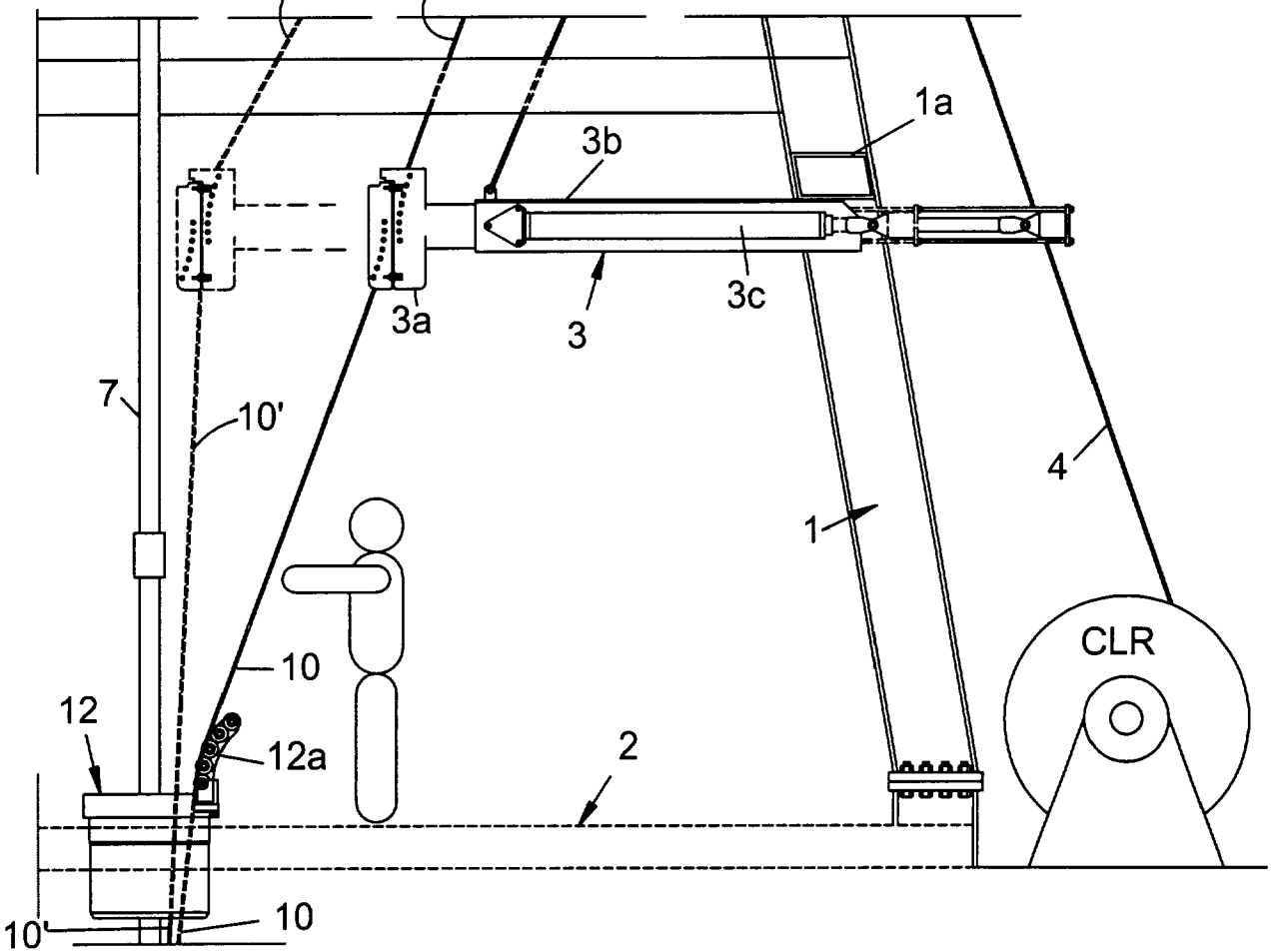
FIG. 1 is a side view of the preferred embodiment, surrounding structure partly cut away, showing the range of principal movements of larger components.

In FIG. 1 both pipe string 7 and control line 4 are being installed in a well. Both string and line feed through the spider 12. While string 7 is supported by the spider, the line 4 assumes line path 10 after passing from a source, or reservoir reel, CLR along a path (not shown) to arrive at the upper end of line path 10. Line path 10 passes through guide rollers in guide head 3*a* and is otherwise generally straight to the spider 12. Line path roller guide 12*a* may be used if handling otherwise tends to damage the control line.

The guide head is means to engage and position the moving control line. Surfaces in the spider housing that facilitate movement of the control line there through will be shown by FIGS. 3 and 4. No spider slips are shown in this figure but they will be closed when the line is in path 10. When the spider slips are to be closed, the line is first moved to path 10. The line 4 is moved to path 10' after the slips are open.

Line thruster 3 is mounted on a convenient beam 1*a* on derrick 1 at a convenient height above the rig floor 2.

To move control line 4 to path 10', the line feed head 3*a* is moved toward the pipe string 7. Hydraulic cylinder 3*c* is mounted on the telescoping ram 3*b*, to manipulate line feed head 3*a* to control the path of line 4. The line is not moving down when in path 10 if the powered line thruster is in use. When the line is to be clamped to pipe 7 and moved downward, with the pipe 7 going into the well, the line 4 is moved to path 10'. The ram 3*b* and cylinder 3*c* are parts of the line thrust means to move the control line toward and away from the pipe string.

Figure 2:
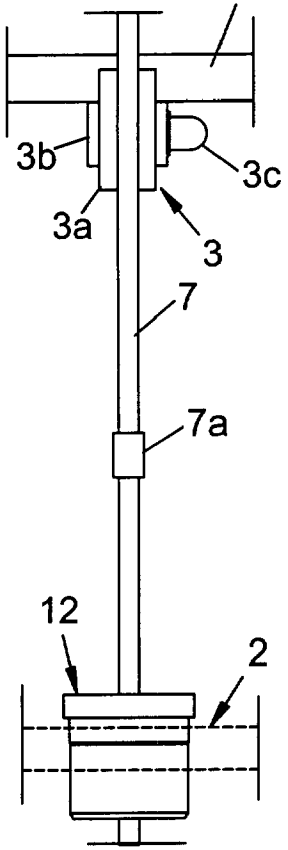
FIG. 2 is a left end view showing the relationship between a pipe string, spider, and one portion of the preferred embodiment.

In FIG. 2 the telescoping assembly 3 is shown mounted on a derrick cross member 1*a*. That is a descriptive convenience and it may be mounted on the rig floor, spider, or other available space. Location is limited only in that it must move line feed head 3*a* toward, and away from, the pipe string 7. A coupling 7*a* is installed between the pipe string and each last-added pipe section.

Figure 3:
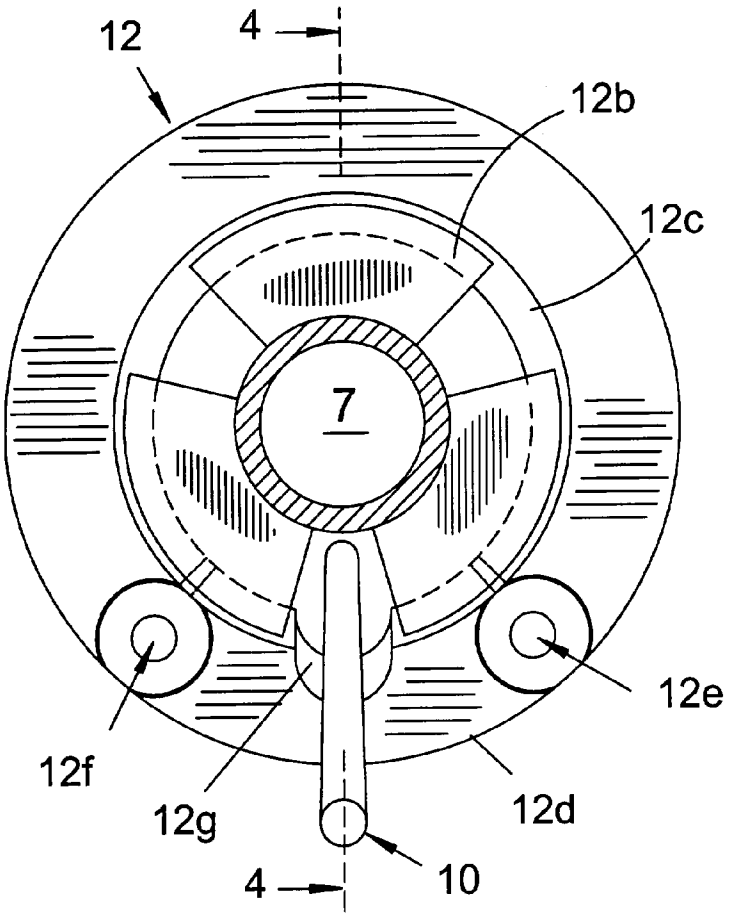
FIG. 3 is a top view of a typical spider with one adaptation that enables use of the apparatus of this invention.
Figure 6:
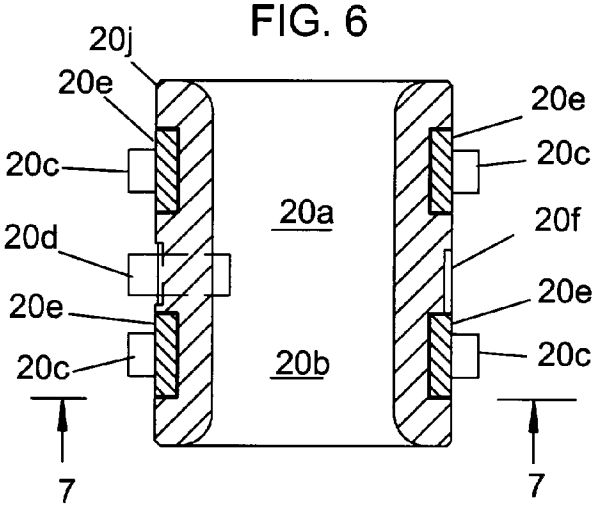
FIG. 6 is a sectional view taken along line 6—6 of FIG. 5.

FIG. 3 is a top view into the bowl of the spider 12 with slips 12*b* installed. Doors are not present on all spiders, but they are on most. Door 12*d* can hinge on either pin 12*e* or 12*f* if the other pin is removed. The door can be altered by groove 12*g* to accept line path 10.

Figure 4:
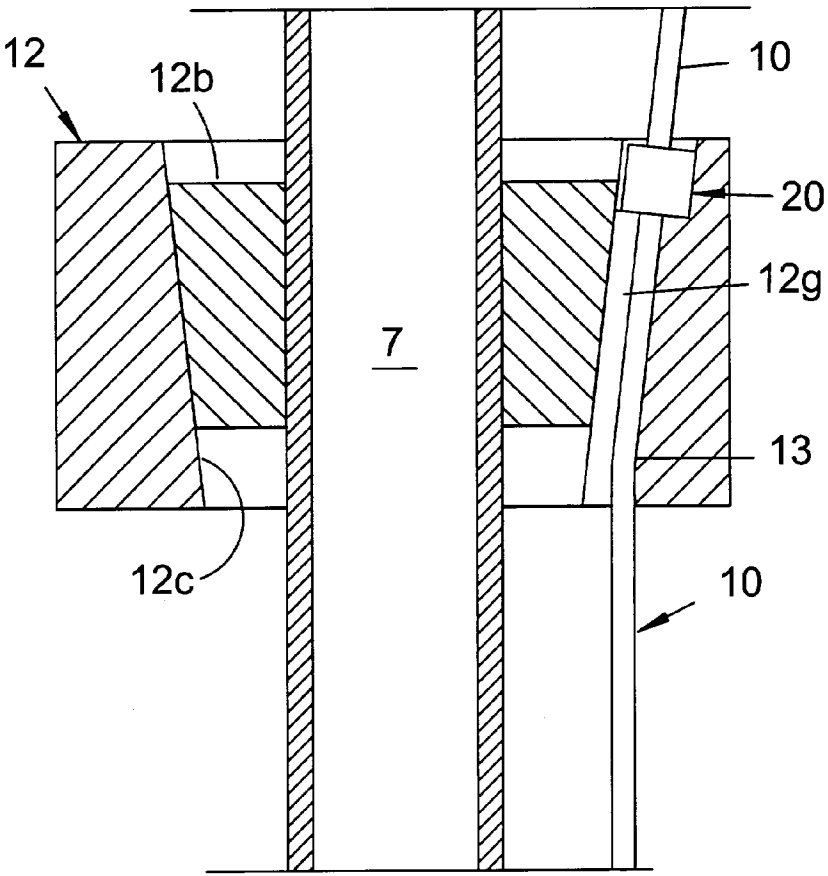
FIG. 4 is a section, taken along line 4—4, showing a preferred control line protector for use in an adaptation of a typical spider.

FIG. 4 shows groove 12*g* rounded off at the lower end by curved surface 13. Not all spiders have slips, such as 12*b*, that collectively wrap the periphery surface 12*c*. If they do cover the periphery when closed, they can harmlessly extend over groove 12*g* without damaging a line firmly held in the groove. The line passage, groove 12*g*, can be cut in spiders having no door. This is one arrangement of the means to conduct the control lines through the spider.

To secure the line in groove 12*g*, an optional line trap can be fitted into (or onto) the spider housing, in the door 12*d* in this case. The trap 20 is selected for minimum intrusion into the usually busy area around the spider. The trap 20, one means to secure the control line, is shown in FIGS. 5–8.

Figure 8:
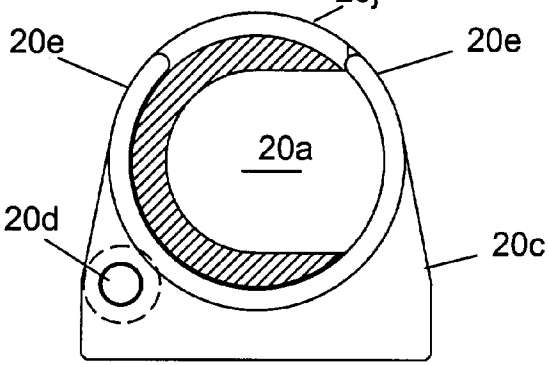
FIG. 8 is an end view, from the aspect of FIG. 7, but actuated to secure control line.
Figure 5:
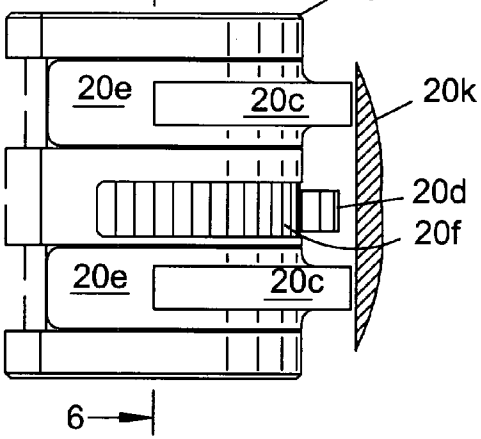
FIG. 5 is a side view of a line trap to be fitted into an adapted spider, an optional feature of the invention.
Figure 7:
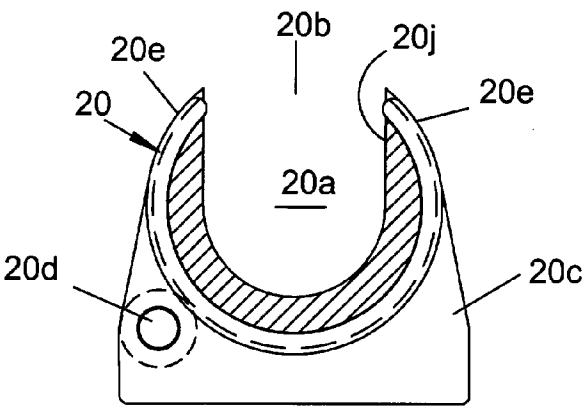
FIG. 7 is an end view of the device of FIG. 5.

FIGS. 5 through 8 disclose the preferred line trap. Components 20*c* can be fastened to base 20*k* to provide stability to yokes 20*e* to provide a secure location for notched drum 20*j*. If the trap is imbedded in the door of the spider, yokes 20*e* can be attached to, or be part of, the door structure to omit frame components 20*c*. In FIG. 7, the open position, line can pass through gap 20*b* in either direction and drum 20*j* can be rotated by pinion 20*d* which engages gear 20*f*. Pinion 20*d* can be rotated by hand, or by a rotating shaft with any power origin. FIG. 8 shows the drum rotated to trap the line in opening 20*a*. If trap 20 is to be only manually operated, the gears 20*d* and 20*f* can be omitted and drum 20*j* can be supplied with a hand lever (not shown) extending some distance from the rotational axis of drum 20*j*.

Figure 9:
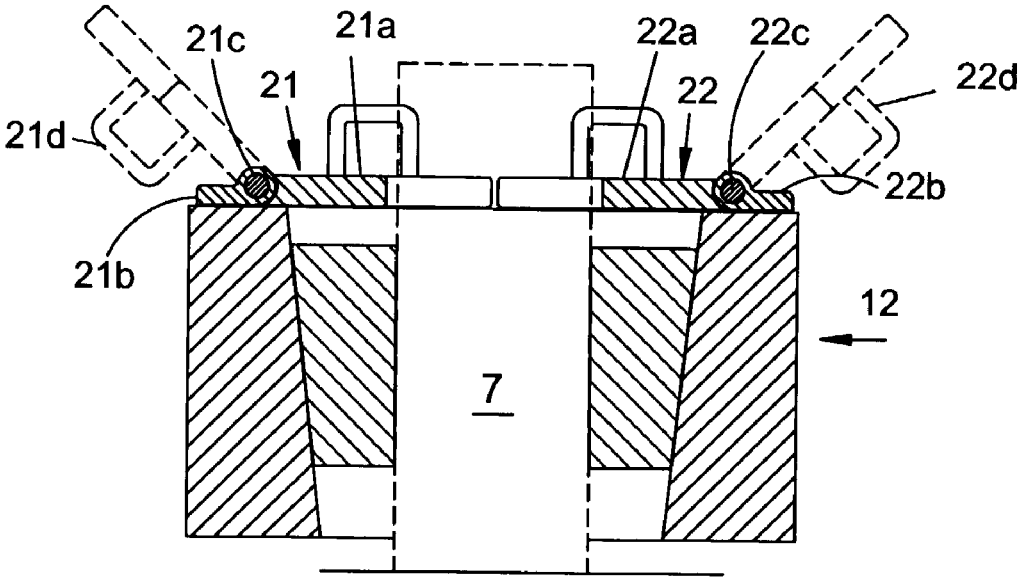
FIG. 9 is a sectional view, taken along line 9—9 of FIG. 10.
Figure 10:
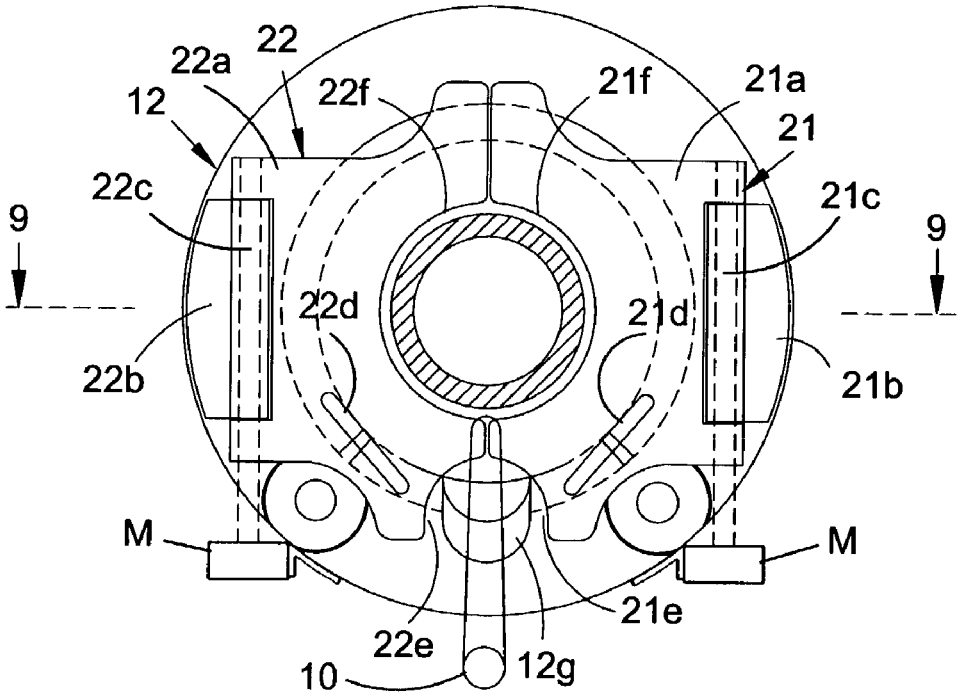
FIG. 10 is a top view of a flap cover form of control line protecting means.
Figure 11B:
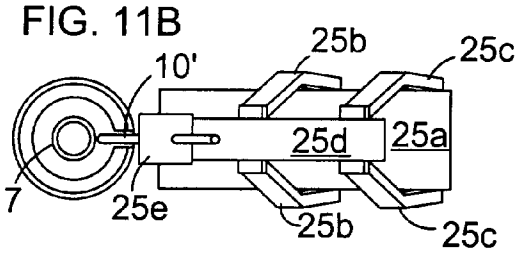
FIGS. 11A and 11B are top views of the apparatus of FIGS. 12A and 12B.
Figure 12B:
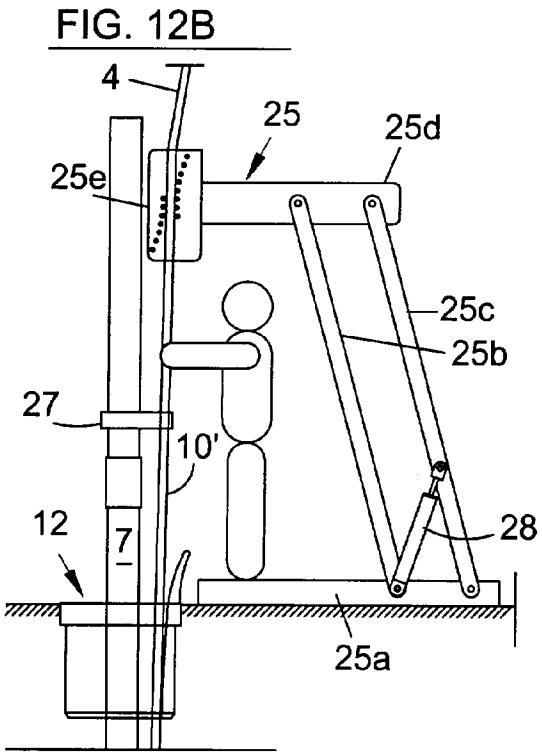
FIGS. 12A and 12B are side views of an alternate form of control line pusher, usable instead of assembly 3 of FIGS. 1 and 2.
Figure 11A:
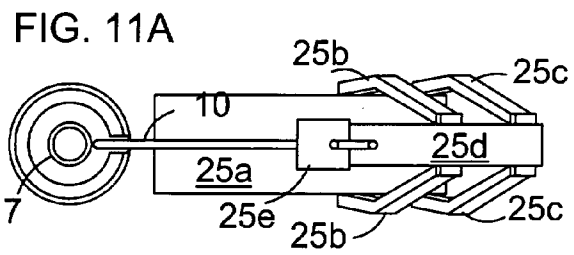
Figure 12A:
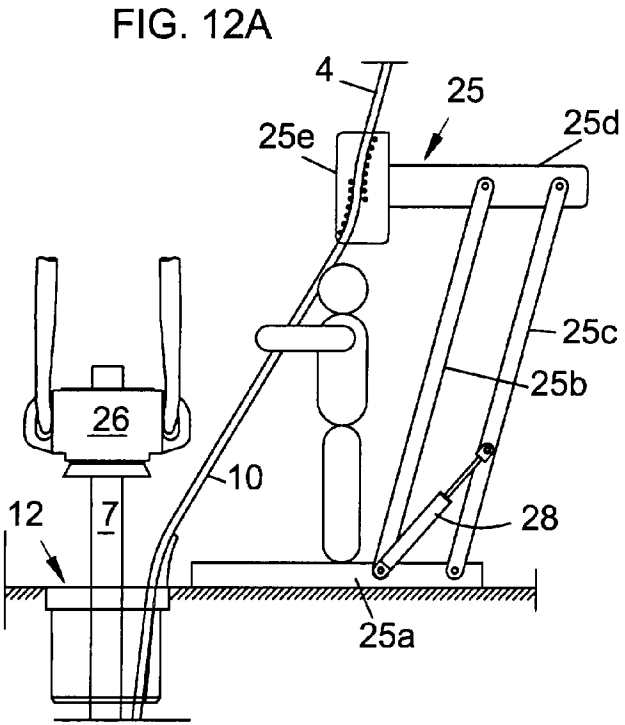

FIGS. 9 and 10 show a flap-type control line trap. Flap assemblies 21 and 22 are each mirrored images of the other. Flaps 21*a* and 22*a* are attached to the body of spider 12 by brackets 21*b* and 22*b* respectively to hinge about shafts 21*c* and 22*c*. Handles 21*d* and 22*d* are for manual handling but power cylinders may be used. Rotary motors M are shown as options for rotating shafts 21*c* and 22*c*, and both flaps, by fluid power. The flaps have arcuate openings 21*f* and 22*f* to accept the pipe 7 and arcuate openings 21*e* and 22*e* for trapping control line in path 10.

FIGS. 11A, 11B, 12A, and 12B show an alternate control line thrust arrangement 25. Line guide head 25*e* on structure 25*d* moves toward and away from pipe 7 when power cylinder 28 moves standard pair 24*c*. Parallel standard pair 25*b* maintains a parallel relationship between member 25*d* and base 25*a*. Elevator 26 gives some idea of the hardware to be cleared by the movable line guide head 25*e*.

The stick man is a six foot symbol and gives some concept of scale and the control line clamp 27 is usually designed for the purpose indicated herein.

Figure 14:
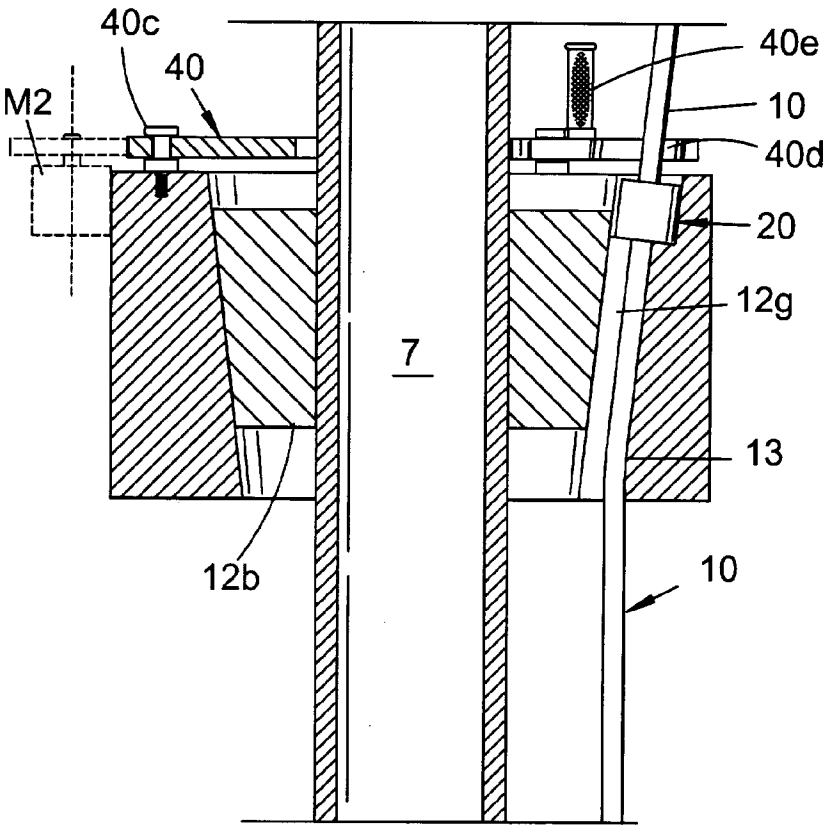
FIG. 14 is a sectional view taken along line 14—14 of FIG. 13.
Figure 13:
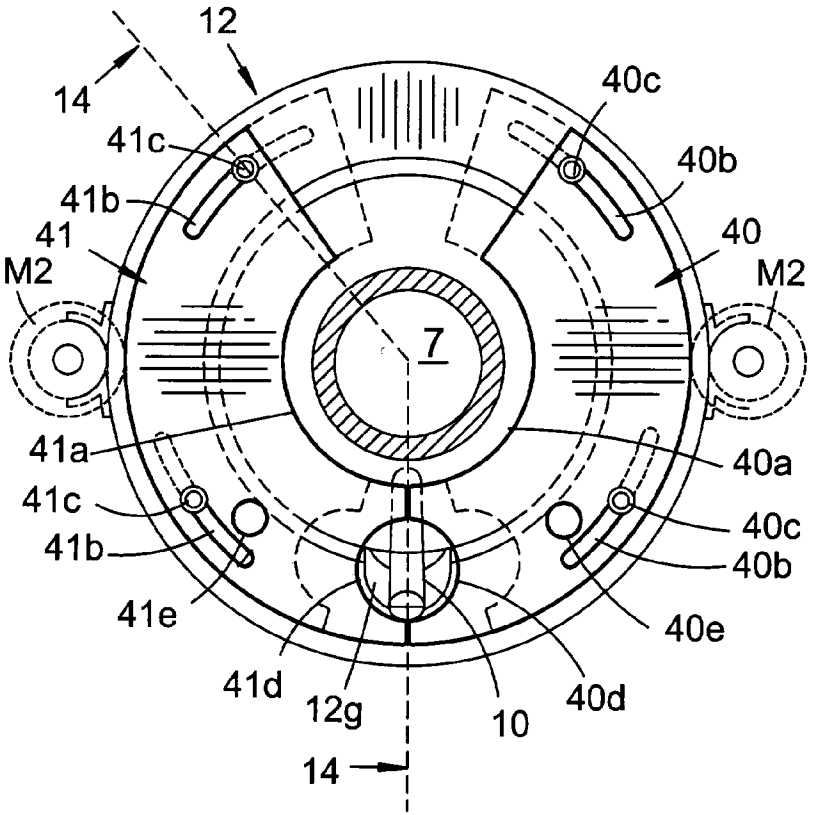
FIG. 13 is a top view of a pivoting plate form of line trap.

FIGS. 13 and 14 show an alternate form of control line trap. The control line trap members move arcuately, in a generally horizontal plane, about the pipe 7. Opening and closing does not change the height of components, relative to the space above the spider. Spider designs differ greatly, usually in the mechanism that operates the slips. No such slip lifting gear is shown (except schematically in FIG. 15) and mounting of all apparatus shown herein is conditioned to accept modification to clear the hardware otherwise on hand.

On spider 12, flange bolts 40*c* and 41*c* carry plates 40 and 41 respectively for arcuate movement in arcuate slits 40*b* and 41*b*. Openings 40*a* and 41*a* accept pipe string 7 and openings 40*d* and 41*d* accept and trap the control line in path 10.

Handles 40*e* ane 41*e* are for manual control of the plates and fluid motors M2 represent means to rotate the plates by fluid power.

FIG. 14 shows trap 20 still in place. Trap 20 can provide a redundant trap, or can be eliminated.

Figure 15:
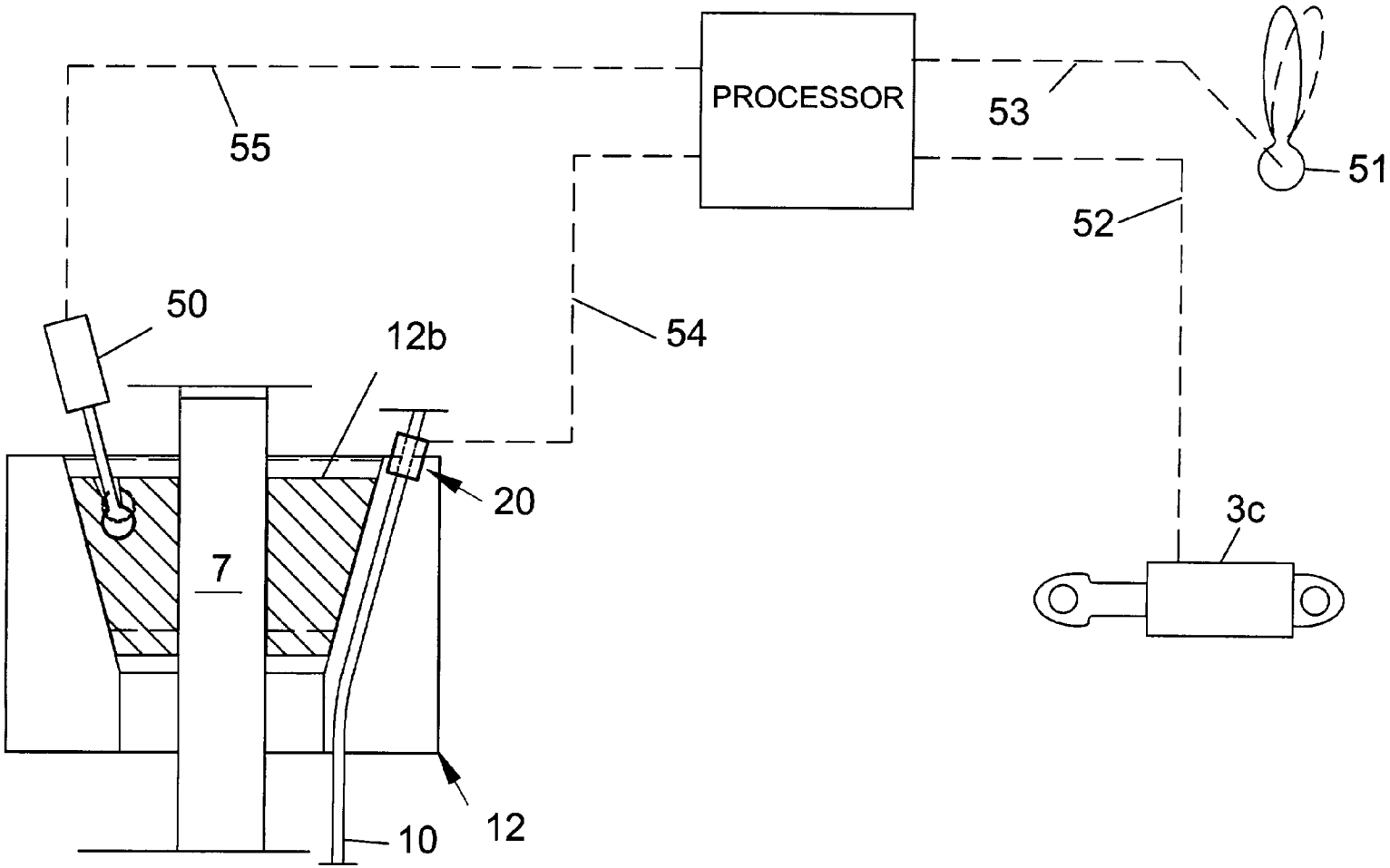
FIG. 15 is a general schematic of an inter-connected version of a system that provides automatic sequencing of individual functions of the overall system.

FIG. 15 shows a schematic of a system arranged for automatic sequencing control. Lines 52, 53, 54, and 55 are signal conducting lines of any form compatible with the related hardware. Those lines can carry actuation command signals from the processor or position information signals back to the processor. The processor responds to the control 51 to actuate the three main functions in the proper sequence for the action at hand. If the spider slips are controlled by other sequencing controls, safety is involved, and the processor must be adapted to that purpose. Mainly, the spider slips must not open when the elevator is not supporting the pipe string. Opening of the spider slips can be used to sequence the opening of the line securing trap.

If outside controls initiate closure of the spider slips and closure is too fast for the control lines to be moved and secured, other preceding events may be used to trigger preparation of the control line for spider slip closing. That event may include last-section position. When the last-added pipe section is half way through the spider the control line may be started away from the pipe string. Closing the line securing means can be started by sensed completion of the line thruster movement. If circumstances permit, closure of the spider slips can be slowed to permit initiating the control line movement by the same signal that initiates closing of the slips with no danger of the control line being damaged.

If the spider slips are open and all is ready for their closure, line thrust motor 3*c* is first actuated to move the line outward to clear slips, then the line trap is closed, slip closing follows either as a result of slow slip control movement or by closing the spider slips by a signal from the sequencer. If the elevator slips are arranged to open only after the spider slips are closed, there is little risk in disabling spider slip closure, by the processor, until the control line is made safe.

In the interest of safety, the spider and elevator working the pipe string may be interconnected such that the spider slips cannot be opened until the elevator slips are closed. Similarly, the elevator slips cannot be opened until the spider slips are closed That prevents the accidental dropping of a string of pipe into a well.

The processor can be set up to enable action of the spider slips only in the proper sequence relative to the control line manipulation. The present system, in that case, would enable or disable signals from other controls, but would not independently cause the spider slips to actuate.

The circuitry is not shown for the processor. The circuitry required whether electric or fluid related is well within the scope of those skilled in the art of controls design.

From the foregoing, it will be seen that this invention is one well adapted to attain all of the ends and objects hereinabove set forth, together with other advantages which are obvious and which are inherent to the invention.

It will be understood that certain features and sub-combinations are of utility and may be employed without reference to other features and sub-combinations. This is contemplated by and is within the scope of the claims.

As many possible embodiments may be made of the control line guide of this invention without departing from the scope thereof, it is to be understood that all matter herein set forth or shown in the accompanying drawings is to be interpreted as illustrative and not in a limiting sense.

The invention having been described, we claim:

1. Control line protecting apparatus for use in well related operations to protect control lines that are installed in a well and attached to a pipe string as the pipe string is being assembled in the well bore, the apparatus comprising:

a) a spider, with a pipe conducting opening for a vertical pipe string, and a plurality of pipe engaging slips;

b) a reservoir to supply the control line to a well location;

c) line thruster above the spider, to move the control line in a generally horizontal direction, toward and away from the pipe string;

d) a conductor to conduct the control lines through the spider, outside a path traveled by the slips while the slips are opening and closing.

2. The apparatus of claim 1 wherein said thruster, for mounting on a drilling rig, is arranged to engage the line with a line guide arranged to position at least part of the control line when the control line is moving into the well.

3. The apparatus of claim 1 wherein said conductor is a channel cut in a wall in the frame of a spider.

4. The apparatus of claim 1 wherein said conductor has a line trap to secure the line in position when the control line is positioned away from the pipe.

5. The apparatus of claim 1 wherein said spider and said line thruster are powered and interconnected by controls to first move the control line away from the pipe, and then close the slips.

6. The apparatus of claim 4 wherein said trap is powered and controlled in relation to movement of slips in said spider, and movement of said line thruster, by sequencing apparatus.

7. A method for protecting control lines being attached to a pipe string, extending through a spider, with spider slips, while both the control lines and the pipe string are being installed into a well, comprising the steps:

a) moving the control lines away from the pipe string;

b) closing a line trap to secure the control lines while the spider slips are closed;

c) closing the spider slips;

d) connecting a new pipe section to the pipe string;

e) transferring the pipe string load to an elevator;

f) opening the spider slips;

g) opening the line trap;

h) moving the control line toward the pipe string; and i) lowering the pipe string into the well.

8. The method of claim 7 wherein the control line is secured to the pipe string after the control line is moved toward the pipe string.

9. The method of claim 8 wherein the control line is secured to the pipe string below a last added pipe string coupling before a new pipe section is added to the pipe string.

10. The method of claim 8 wherein the control line is secured to the pipe string above a last added pipe string coupling after a new pipe section is added to the pipe string.

11. Control line protecting apparatus for use in well related operations to protect control lines that are installed in a well and attached to a pipe string as the pipe string is being assembled in the well bore, the apparatus comprising:

a) a spider, with a pipe conducting opening for a vertical pipe string, and a plurality of pipe engaging slips;

b) a reservoir to supply the control line to a well location;

c) a conductor to conduct the control lines through the spider, outside a path traveled by the slips while they are opening and closing;

d) a line trap, secured to the spider, to releasably retain the control lines therein.

12. The control line protecting apparatus of claim 11 wherein powered line thruster is provided, above the spider, to move the control line toward and away from the pipe string.

* * * * *

UNITED STATES PATENT AND TRADEMARK OFFICE

CERTIFICATE OF CORRECTION

PATENT NO. : 6,920,931 B1
APPLICATION NO. : 10/315617
DATED : July 26, 2005
INVENTOR(S) : Charles Michael Webre et al.

It is certified that error appears in the above-identified patent and that said Letters Patent is hereby corrected as shown below:

On the Title Page:

On the Title Page, Item (57), in the Abstract, line 2, the word "pie" should be --pipe--.

Signed and Sealed this

Fifteenth Day of December, 2009

David J. Kappos

David J. Kappos
*Director of the United States Patent and Trademark Office*